US010890055B2

(12) United States Patent
Pavlov et al.

(10) Patent No.: US 10,890,055 B2
(45) Date of Patent: Jan. 12, 2021

(54) METHOD FOR INVERTING OIL CONTINUOUS FLOW TO WATER CONTINUOUS FLOW

(71) Applicant: STATOIL PETROLEUM AS, Stavanger (NO)

(72) Inventors: Alexey Pavlov, Porsgrunn (NO); Kjetil Fjalestad, Skien (NO)

(73) Assignee: STATOIL PETROLEUM AS, Stavanger (NO)

( * ) Notice: Subject to any disclaimer, the term of this patent is extended or adjusted under 35 U.S.C. 154(b) by 231 days.

(21) Appl. No.: 15/569,698

(22) PCT Filed: Apr. 27, 2015

(86) PCT No.: PCT/EP2015/059102
§ 371 (c)(1),
(2) Date: Oct. 26, 2017

(87) PCT Pub. No.: WO2016/173617
PCT Pub. Date: Nov. 3, 2016

(65) Prior Publication Data
US 2018/0128088 A1 May 10, 2018

(51) Int. Cl.
*E21B 43/12* (2006.01)

(52) U.S. Cl.
CPC ..... *E21B 43/12* (2013.01); *E21B 43/121* (2013.01); *E21B 43/128* (2013.01)

(58) Field of Classification Search
CPC .... E21B 43/128; E21B 47/0007; E21B 43/16; E21B 44/06; E21B 43/12; F04D 15/0245; F04D 15/0209
See application file for complete search history.

(56) References Cited

U.S. PATENT DOCUMENTS 4,126,182 A * 11/1978 Allen ..... E21B 43/00 137/13
5,110,443 A * 5/1992 Gregoli ..... B01F 3/0811 137/13

(Continued)

FOREIGN PATENT DOCUMENTS

RU 2470148 C2 12/2012
RU 2501591 C2 12/2013
RU 2515585 C2 5/2014

*Primary Examiner* — Michael R Wills, III
(74) *Attorney, Agent, or Firm* — Birch, Stewart, Kolasch & Birch, LLP

(57) ABSTRACT

The present invention provides a method for inverting oil continuous flow to water continuous flow and reaching one or more desired production parameters in a well producing fluid containing oil and water or inverting oil continuous flow to water continuous flow and reaching one or more desired transport parameters in a pipeline transporting fluid containing oil and water wherein there is a pump in the well or transport pipeline, comprising the following steps: (a) reducing the pump frequency until either inversion from oil continuous production to water continuous flow is achieved or a predefined stopping condition is reached; (b) if inversion has not been achieved in step (a), adjusting the wellhead pressure in the well or the pressure at the reception side of the transport line to achieve the inversion; (c) stabilising the flow at the condition reached in steps (a) or (b); and (d) carefully adjusting one or both of the wellhead pressure and pump frequency to reach the one or more desired production parameters.

28 Claims, 4 Drawing Sheets

(56) References Cited

U.S. PATENT DOCUMENTS

| | | | | |
|---|---|---|---|---|
| 5,263,848 | A * | 11/1993 | Gregoli | B01F 3/0811 137/13 |
| 10,125,584 | B2 * | 11/2018 | Aske | E21B 43/128 |
| 2001/0033795 | A1 | 10/2001 | Humpheries | |
| 2005/0173114 | A1 | 8/2005 | Cudmore et al. | |
| 2005/0250860 | A1 * | 11/2005 | Appleford | B01D 17/0208 516/135 |
| 2007/0187110 | A1 * | 8/2007 | Lima Goncalves | E21B 33/035 166/368 |
| 2008/0245530 | A1 * | 10/2008 | Kuzmichev | E21B 43/12 166/369 |
| 2008/0262735 | A1 | 10/2008 | Thigpen et al. | |
| 2008/0262736 | A1 * | 10/2008 | Thigpen | E21B 43/128 702/9 |
| 2008/0306892 | A1 | 12/2008 | Crossley et al. | |
| 2009/0000790 | A1 * | 1/2009 | Bertane | E21B 43/126 166/370 |
| 2010/0218954 | A1 | 9/2010 | Yale et al. | |
| 2010/0319904 | A1 | 12/2010 | Morrow | |
| 2011/0152386 | A1 | 6/2011 | Gäbler et al. | |
| 2016/0290077 | A1 * | 10/2016 | Aske | E21B 43/128 |

* cited by examiner

METHOD FOR INVERTING OIL CONTINUOUS FLOW TO WATER CONTINUOUS FLOW

FIELD OF THE INVENTION

The invention relates to a method for actively inverting oil continuous flow of fluid containing oil and water to water continuous flow in a well comprising a means of artificial lift such as an Electrical Submersible Pump or in an oil transport line assisted by pumps.

BACKGROUND OF THE INVENTION

In oil wells with downhole pumps as artificial lift means, the injection of lighter oil as a diluent (e.g. light oil with a low viscosity) and/or other fluids (e.g. water, or chemicals like emulsion breaker) may be used to reduce the viscosity of the fluid produced. High viscosity of the produced fluid can significantly reduce the efficiency of the downhole pump and increase the frictional pressure drop in the well. Therefore, solutions to increase pump efficiency and reduce frictional pressure losses downstream of the pump will lead to increased and accelerated production and reduction of the electric power consumption needed for the pump. A schematic of a typical well with a downhole pump is shown in FIG. 1. In the same way, solutions to reduce fluid viscosity in transport pipelines assisted with pumps will lead to reduction of electric power consumption by the pumps and enable higher transport rates.

As the water cut increases in a well or in a transport line, particularly in the case of viscous (heavy) oil, the fluid viscosity increases while producing in the oil continuous flow regime. This usually reduces the efficiency of the pump and, at the same time, increases the frictional pressure drop in the pipe. As a consequence, the power consumption by the pump (for example, an Electric Submersible Pump (ESP)) will be high. In combination with constraints on operating parameters of the pump (e.g. maximal electrical current, power, pump speed), high fluid viscosity also limits production rates.

To reduce the high fluid viscosity of the oil continuous flow regime, several already existing methods can be applied. Injection of emulsion breaker can reduce the water cut at which highly viscous oil continuous flow inverts to water continuous flow with lower viscosity. Injection of water can also invert the flow into water continuous by increasing of the water cut of the fluid consisting of the produced (transported) fluid and the injected water. Alternatively, injection of diluent (lighter oil) can reduce fluid viscosity without inverting it to the water continuous flow regime. All these methods apply to both production wells and transport pipelines. However, there are a number of drawbacks with these known techniques which limit their use in practice.

For example, adding water, diluent or emulsion breaker requires extra injection pipelines and facilities, which may not be available. Moreover, injection of water and diluent also takes some of the pump capacity (as there is more fluid to pump), resulting in higher pump power consumption.

There is therefore a need for an improved method for the conversion of oil continuous flow to water continuous flow which overcomes the problems encountered in the known methods as set out above.

SUMMARY OF THE INVENTION

The present inventors have discovered a very different approach for inverting oil continuous flow to water continuous flow in a well with a pump as an artificial lift means or in a transport line assisted by pump(s). The method reduces the power used by the pumps and/or increases the production rate or transport rate as a result of the inversion to water continuous production, which can be achieved quickly and easily.

Thus, in a first aspect of the present invention there is provided a method for inverting oil continuous flow to water continuous flow and reaching one or more desired production parameters in a well producing fluid containing oil and water or inverting oil continuous flow to water continuous flow and reaching one or more desired transport parameters in a pipeline transporting fluid containing oil and water wherein there is a pump in the well or transport pipeline, comprising the following steps:

(a) reducing the pump frequency until either inversion from oil continuous flow to water continuous flow is achieved or a predefined stopping condition is achieved;

(b) if inversion has not been achieved in step (a), adjusting the wellhead pressure in the well or the pressure at the reception side of the transport line to achieve the inversion;

(c) optionally, stabilising the flow at the condition reached in steps (a) or (b); and (d) optionally, carefully increasing one or both of the wellhead pressure and pump frequency to reach the one or more desired production parameters in the well or the pump frequency and the pressure at the reception side of the transport pipeline to reach the one or more desired transport parameters in the transport pipeline without reversion to oil continuous production or oil continuous transport if they have not been reached in steps (a), (b) or (c).

The present invention addresses the previously known methods used for inversion of flow from oil continuous flow to water continuous flow. Instead of adding water or emulsion breaker to cause inversion, it is possible to achieve the desired inversion through the adjustment of only the frequency of the pump and the pressure at the well head (or pump frequency and the pressure at reception side of the transport line, in the case of a transport line). By inverting the flow and thus reducing the frictional pressure drop, and also increasing the efficiency of the pump (since the viscosity of the mixture is reduced), less power is required to maintain the production from a well or to pump the fluid mixture through a transport line. Moreover, the freed power can be used to increase the production rate from an oil well.

Power consumption from the inversion may reduce by up to 40% (for the same production flow rate). Field tests indicate a potential increase of production rate of up to 15-20% (this is dependent upon fluid, well, and pump).

DETAILED DESCRIPTION OF THE INVENTION

Figure 1:
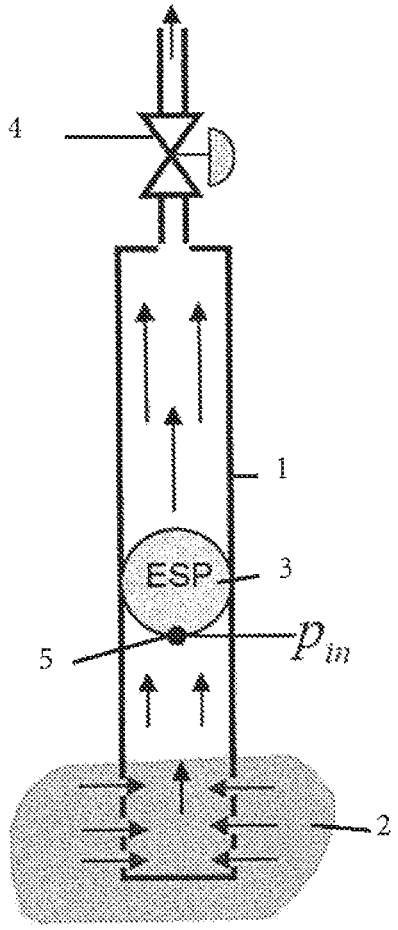
Figure 1 Prior Art
FIG. 1 is a schematic representation of a well comprising an Electric Submersible Pump.

The method of the present invention is highly advantageous as there is a significant reduction in power consumption by the pump as a result of the reduced viscosity of the water continuous flow as compared to oil continuous. This saving in power can be used to increase production from the well or from other wells in the field. The method of the present invention is also superior to adding water, diluent, emulsion breaker or other viscosity reducing fluid, which has the disadvantage of requiring extra pipeline and facilities, which also takes some of the pump capacity as it takes more fluid to the pump. The method of the present of the present invention enables inversion from an oil continuous flow to water continuous flow simply by the adjustment of the frequency of the pump and/or the pressure at the well head, or, in the case of the application to transport pipelines, by adjusting the frequency of the pump and/or the pressure at the reception side of the transport pipeline In one embodiment of the present invention, there is provided a method wherein, no changes are made to the well or pipeline parameters in step (c) of the method of the present invention and the well or pipeline are allowed to flow at the conditions reached in (a) or (b).

In another embodiment of the present invention, there is provided a method wherein the pump frequency is reduced further in step (c) of the method of the present invention until a predefined limit is reached and then production is continued at that lower pump frequency.

In a further embodiment of the method of the present invention, there is provided a method wherein the pump frequency and/or well head pressure are adjusted in step (c) of the method of the present invention to maintain a selected well or pump parameter at a constant level reached in steps (a) or (b). Preferably, the well or pump parameter is selected from well flow rate, pipeline flow rate, differential pressure over the pump, pump discharge pressure and pump intake pressure.

The desired production parameters in the well are preferably selected from the group consisting of: the desired flow rate, the desired temperature at the well location, the desired temperature at the pump intake, the desired temperature at the desired pump discharge, the desired temperature at the pump motor, the desired pressure at a location in the well, the desired pressure at the pump intake, the desired pressure at the pump intake discharge, the desired pump power, the desired pump current and the desired pump frequency.

The desired transport parameters in the pipeline are one or more parameters selected from the group consisting of: the desired flow rate, the desired temperature at a location in the pipeline, the desired temperature at the pump intake, the desired temperature at the pump discharge, the desired temperature at the pump motor, the desired pressure at a location in the pipeline, the desired pressure at the pump intake, the desired pressure at the pump discharge, the desired pump power, the desired pump current and the desired pump frequency.

In one embodiment of the present invention, the pump may be a downhole pump. A downhole pump is a pump that is situated inside a well to provide artificial lift to the fluid produced in the well. Typically, the downhole pump may be an electrical submersible pump (ESP) or other type of pump, and preferably an ESP.

In another embodiment according to the present invention the well is an oil producing well such as a vertical well. The well may be, for example, a heavy oil well or viscous oil well.

In an alternative embodiment of the present invention, the pump is a pump in an oil transport line.

The present method applies to an oil continuous flow in a well or a transport pipeline producing or, respectively, transporting, fluid containing oil and water. The pump frequency is reduced until inversion from oil continuous flow to water continuous flow in the well or in the transport pipeline is achieved or a pre-specified stopping condition is reached. For example, the reduction of the pump frequency can be stopped if the minimal frequency is reached, or the minimal flow is reached, as indicated by available measurements. If inversion is not observed in step (a) or step (b), the wellhead pressure is adjusted to reach the inversion to water continuous flow regime. For the case of transport line application, the pressure at the reception side of the transport line is adjusted to reach inversion. For example, the pressure can be increased. This can be achieved by, for example, a valve, or by another pump, or by other equipment types that affect the pressure and are located downstream the well head (downstream the reception end of the transport pipeline for the transport application).

The flow of the fluid produced from the well or the flow of the fluid transported through the transport pipeline is then stabilized at the conditions reached in steps (a) and (b). This can be done either by:

- not modifying parameters of production or transport for a certain period of time
- further reducing the pump frequency until a predefined limit and producing at that lower ESP speed (this stabilises the water continuous flow regime)
- adjusting pump frequency and/or well head pressure (pressure at the reception side of the transport line for the transport pipeline application) to maintain a selected well or pump parameter at a constant level reached in steps (a) or (b). For example, one can maintain constant flow rate or constant pump intake pressure for a suitable period.

In optional step (d), one or both of the wellhead pressure and pump frequency are carefully adjusted to reach the one or more desired production parameters in the well or one or both of the pump frequency and the pressure at the reception side of the transport pipeline are carefully increased to reach the one or more desired transport parameters in the transport pipeline without reversion to oil continuous production or oil continuous transport if they have not been reached in steps (a) or (b) or optional step (c). It may happen that after the stabilization step, the production or transport already has desired parameters in the water continuous flow regime, such that further adjustment of the pump frequency is not necessary.

In one preferred embodiment of the present invention, stabilisation of the flow of the fluid produced from a well at the minimum rate achieved in (a) or (b) is achieved in step (c) by adjustment of the pump frequency or pressure at the well head by means of a well head choke or another pump downstream of the well head choke.

In the case of flow in a transport line, stabilisation of the flow transported through a transport pipeline at the minimum rate achieved in (a) or (b) is achieved in step (c) by adjustment of the pump frequency or pressure at the reception side of the transport line by means of a choke, a valve or a second pump.

In one embodiment of the method of the present invention, each of steps (a) and (b) and optional steps (c) and (d), as required by the method, is conducted manually by an operator, monitoring the pump and the well or the pump and the transport pipeline and making appropriate changes as required to the pump frequency and well head pressure or pump frequency and the pressure at the reception side of the transport pipeline as required.

Alternatively, each of steps (a) and (b) and optional steps (c) and (d), as required by the method, is conducted fully automatically, wherein an automatic control system conducts the necessary adjustments in each of steps (a) and (b) and optional steps (c) and (d), as required. In one preferred aspect of such a system, the automatic system conducts each of steps (a) and (b) and optional steps (c) and (d), as required by the method. In one option, each of steps (a) and (b) and optional steps (c) and (d), as required by the method, is conducted by the automatic control system on a regular basis determined on the basis of the well or transport line conditions. The automatic system may conduct each of steps (a) and (b) and optional steps (c) and (d), as required by the method, indirectly by automatic control of one or more other well or pump parameters.

One aspect of the embodiment of the method wherein each of steps (a) and (b) and optional steps (c) and (d), as required by the method, is conducted fully automatically, is performed on the basis of feedback from sensors measuring one or more well or transport pipeline parameters selected from the group consisting of: fluid viscosity, fluid flow rate, pressure at a well location, differential pressure over the pump, pump discharge pressure, pressure at a transport line location, pressure at a pump intake, pressure at a pump discharge, temperature at a well location, temperature at a transport line location, temperature at a pump intake, temperature at a pump discharge, temperature at a pump motor, pump frequency, pump power, pump current, choke opening, valve opening, or estimates of other parameters calculated from said measurements.

In a third alternative, each of steps (a) and (b) and optional steps (c) and (d), as required by the method, is conducted semi-automatically, wherein at least one of steps (a) and (b) and optional steps (c) and (d), as required by the method, is conducted by an automatic control system but the decision making is done by an operator. In one preferred embodiment of this, the automatic system conducts each of steps (a) and (b) and optional steps (c) and (d), as required by the method, in a well or transport pipeline on the basis of feedback from sensors measuring one or more well or transport pipeline parameters selected from the group consisting of: fluid viscosity, fluid flow rate, pressure at a well location, differential pressure over the pump, pump discharge pressure, pressure at a transport line location, pressure at a pump intake, pressure at a pump discharge, temperature at a well location, temperature at a transport line location, temperature at a pump intake, temperature at a pump discharge, temperature at a pump motor, pump frequency, pump power, pump current, choke opening, valve opening, or estimates of other parameters calculated from said measurements.

The method of the present invention can be extended further by combining it with injection of liquids that affect the fluid viscosity either by changing the inversion point water cut or by reducing the viscosity directly. The fluids may include emulsion breaker or other chemicals, diluent (lighter oil), or water, or a combination thereof. The injection can be at constant or varying injection rates. Thus, in a further embodiment of the method of the present invention there is provided the further step of injection of a viscosity affecting fluid into the well or transport pipeline upstream of the pump. Preferably, the viscosity affecting fluid is selected from a diluent, water and an emulsion breaker. For example, an emulsion breaker may be injected upstream of a downhole pump in an oil well or upstream of a pump in an oil transport line in any of steps (a) and (b) and optional steps (c) or (d) to assist inversion of the flow.

In another embodiment of the present invention, in an oil well in which diluent was injected prior to the inversion, the injection of diluent can be reduced or stopped to assist inversion of flow during steps (a) or (b) or optional steps (c) or (d).

In another embodiment of the present invention, in an oil well in which emulsion breaker was injected prior to the inversion, the injection rate of emulsion breaker remains at the same or higher level to assist inversion of flow during steps (a) or (b) or optional steps (c) or (d).

The method can also be applied when starting a well after a shut in period. In this case, after a period when a well has been out of production, step (b) and, optionally step (c) and further optionally step (d) of the method of the present invention are applied to the production of fluid from said well after production starts at low frequency and low production rate.

The present invention is based on the following observation. Laboratory experiments with a full scale Electric Submersible Pump (ESP) (discussed further below) indicate that there is a range of water cuts for which the ESP can pump the fluid both in oil-continuous and in water-continuous regimes for the same flow rate. This shows itself, for example, in the hysteresis of the ESP power used for pumping. Moreover, it has been shown that by reducing the ESP frequency (and therefore flow rate through the pump) the oil continuous flow can invert to water continuous flow and stay in that flow regime. Subsequent slow increase of the ESP frequency and production rate (as follows from laboratory tests) does not invert the flow back to oil continuous regime. The resulting water continuous flow regime will be at the pump, and, possibly, in the whole pipeline or at a section downstream the pump.

By inversion of the flow it is possible to reduce the frictional pressure drop, and also increase the efficiency of the pump (since the mixture viscosity is reduced), and as a consequence less electric power is required to maintain the production. Moreover, the freed power can be used to increase production rate either at the same well, or at other wells. Power consumption from the inversion may be reduced by up to 40% (for the same production flow rate) using the method of the present invention. Field tests indicate potential increase of production rate of up to 20% (these are dependent upon the fluid, the well and the pump). Similar issues apply to transport of fluids containing oil and water in a transport line and efficiencies are achievable with the method of the present invention.

If the flow is inverted and thus the frictional pressure drop is reduced, the following is achieved:

- Production rate can be increased with the same (or lower) power consumption
- Electric power consumption is reduced
- ESP or other pump efficiency will be improved which can be useful for the pump life time, as well as for motor cooling.

The method itself is very simple for implementation and does not require any sensors in addition to the standard downhole pump and well sensors.

The method itself does not require any chemicals, or injection lines or any ways of influencing the well other than adjusting ESP and other downhole pump frequency and wellhead pressure (or pump frequency and pressure at the reception side of the transport line for the transport application), which are available for most of ESP and other downhole pump lifted wells and in most transport lines assisted with pumps. However, it can be combined with any other methods like injection of diluent/water/chemicals (e.g. emulsion breakers) at constant or varying injection rates.

The present invention may be understood further by consideration of the following examples of the method of the present invention.

A schematic for a typical well with a downhole pump is illustrated in FIG. 1. Each well 1 has a reservoir 2 containing fluid to be produced. The fluid is typically a mixture of oil, water and, possibly, gas. To provide artificial lift for the fluid from the reservoir, the well is provided with a downhole pump, for example, in the form of an Electrical Submersible Pump (ESP) 3. Well head pressure can be varied by means of the well head choke 4. The pressure at the intake of the ESP $P_{in}$ can be varied by means of the frequency of the pump 3 and the choke 4. The oil is pumped by the ESP 3 via the production choke 4 to the production manifold be pumped to the production facility.

Figure 2A:
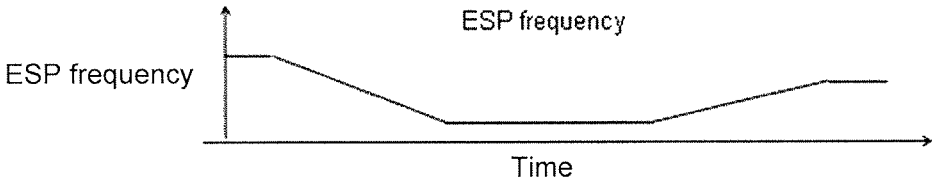
FIG. 2 provides plots of ESP frequency against time, ESP intake pressure against time and power against time showing the reduction of power consumption by the ESP.
Figure 2B:
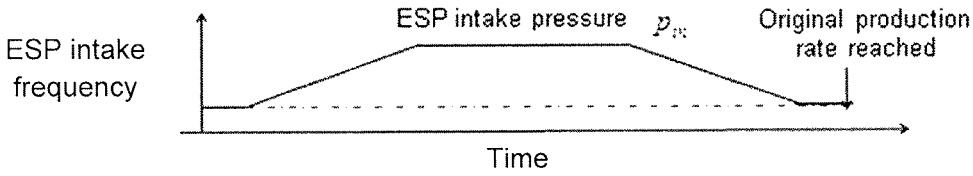
Figure 2C:
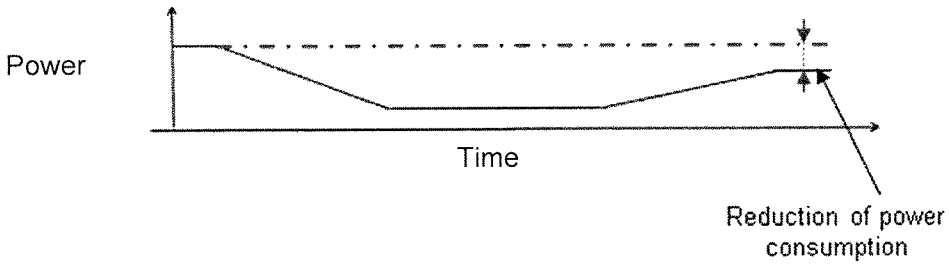

FIG. 2 shows an example of the application of the inversion method of the present invention through plots of ESP frequency against time, ESP intake pressure against time and power consumption by the ESP against time obtained. The three plots are arranged so that the measurements can be compared directly with one another over the course of a process according to the method of the present invention for inverting oil continuous production of oil from a well to water continuous production.

Thus, it can be seen that initially [corresponding to step (a) of the method of the invention], the ESP frequency was gradually reduced until inversion from oil continuous production to water continuous production took place (this can be observed from monitoring measurements from the well and from the pump). At the same time there was a corresponding increase in the ESP intake pressure $P_{in}$ and a reduction in the ESP power consumption. As a result, there was an accompanying decrease in oil production rate.

Since inversion has been achieved and observed, there is no need in additional adjustments of the wellhead pressure to reach the water continuous flow regime.

There was then a 'plateau' step when the ESP frequency, ESP intake pressure and power consumption all remain the steady. This corresponds to step (b) of the method of the present invention, in which the flow of the fluid is stabilized in the water-continuous flow regime.

Finally, in a third step the ESP frequency was gradually increased. This was accompanied by a decrease of the ESP intake pressure. The increase of the ESP frequency was stopped when the intake pressure had reached the same level as before step (a), which corresponds to the same production rate as before applying the inversion method. However, as can be seen from the plots of both ESP frequency and power consumption, both were below their original values at the end of the inversion method. The difference between the final power consumption value and the original value gives the reduction of power consumption achieved by means of inverting to water continuous flow by means of the method of the present invention.

Laboratory experiments were conducted in an emulated well with a full scale ESP. It was found that there was hysteresis in the inversion between oil and water continuous flow regime, such that production at a certain water cut range can be both in oil continuous and in water continuous flow regimes. Moreover, it was found that the inversion point is achieved with lower water cut when the ESP speed was low. This enables the possibility to switch from the oil continuous flow regime to water continuous flow regime by means of, firstly, reducing the ESP frequency and flow rate, stabilizing the flow at these conditions and then, increasing the ESP frequency.

Figure 3:
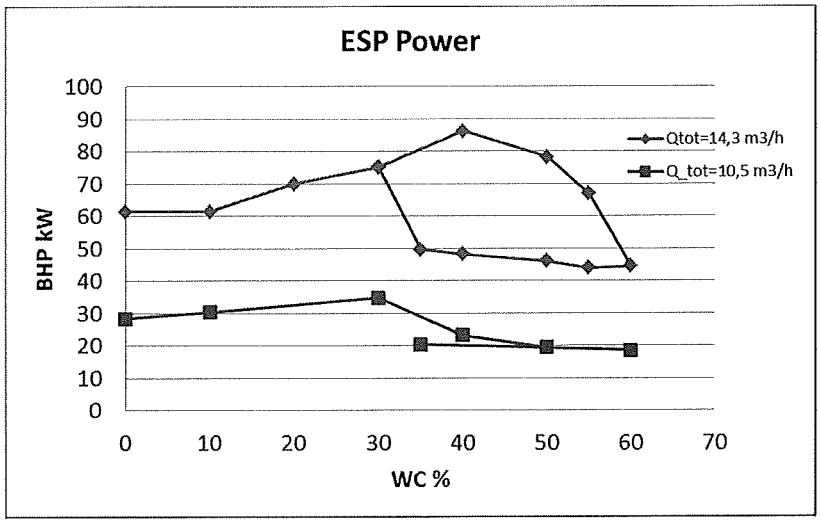
FIG. 3 shows a plot of ESP power against water cut % showing the inversion from oil continuous to water continuous regimes.

Specifically, a plot was made of ESP frequency against water cut % (see FIG. 3). When production was conducted at a high ESP frequency and high production rate, it was found that inversion from oil continuous to water continuous took place at about 32% water cut and 58% water cut on a hysteresis loop. Between these points production is possible both in oil continuous (top branch) and water continuous (bottom branch), with production usually following the oil continuous branch. The method of the proposed invention was applied when the water cut was about 40%.

Figure 4:
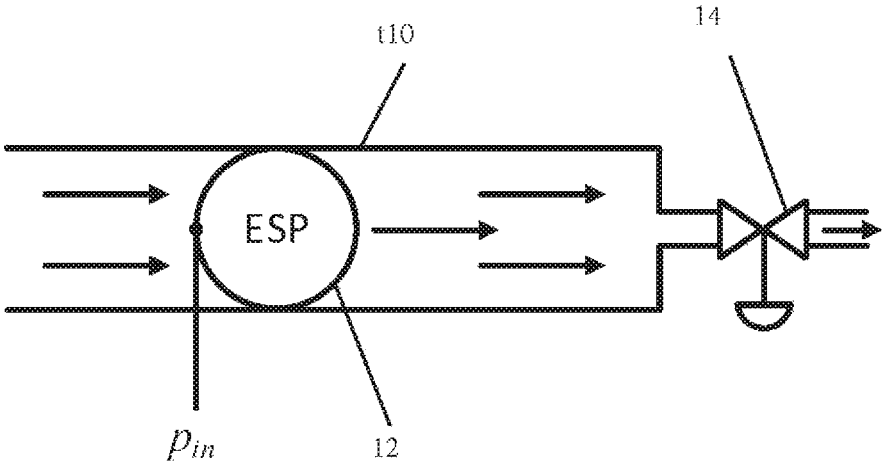
FIG. 4 shows a pump present in a transport pipeline.

FIG. 4 illustrates a pump 12, which may be an ESP, a transport pipeline 10 provided in a well, a well head choke 14 for varying well head pressure an intake $p_m$ of the pump 12, which can be varied by means of the frequency of the pump 12 and the choke 14. The oil is pumped by the pump 12 via the production choke 14 to a production manifold be pumped to a production facility.

By reducing the frequency and flow rate, it was demonstrated that the flow regime moved from oil continuous flow at high ESP frequency to water continuous flow at low ESP frequency. When the ESP frequency was gradually increased to increase the production rate, it was found that inversion back to oil continuous flow did not occur and the initial production rate (or higher) resumed in a water continuous flow.

The invention claimed is:

1. A method for inverting oil continuous flow to water continuous flow and reaching one or more desired production parameters in a well producing fluid containing oil and water wherein there is a pump having a pump frequency in a well, comprising the following steps:

(a) reducing the pump frequency until either inversion from oil continuous flow to water continuous flow is achieved, a minimal frequency is reached, or a minimal flow is reached;

(b) if inversion has not been achieved in step (a), adjusting wellhead pressure in the well to achieve the inversion; and (c) stabilising the flow at the condition reached in steps (a) or (b).

2. The method according to claim 1, wherein no changes are made to the pump frequency or wellhead pressure in step (c) and the well is allowed to flow at the conditions reached in (a) or (b).

3. The method according to claim 1, wherein the pump frequency is reduced further in step (c) until a predefined limit is reached and then production is continued at that lower pump frequency or the pump frequency and/or wellhead pressure is adjusted in step (c) to maintain a selected well parameter at a constant level reached in steps (a) or (b).

4. The method according to claim 3, wherein said well parameter is selected from well flow rate, differential pressure over the pump, pump discharge pressure and pump intake pressure.

5. The method according to claim 1, wherein the desired production parameters in the well are one or more parameters selected from the group consisting of: the desired flow rate, the desired temperature at a location in the well, the desired temperature at the pump intake, the desired temperature at the pump discharge, the desired temperature at the pump motor, the desired pressure at the well location, the desired pressure at the pump intake discharge, the desired pump power, the desired pump current and the desired pump frequency.

6. The method according to claim 1, wherein the well is a well producing viscous oil.

7. The method according to claim 1, wherein the pressure at the wellhead is adjusted in step (b) by adjustment of a wellhead choke or by adjustment of the pressure downstream of the wellhead choke by means of a pump, or a valve downstream of the wellhead choke.

8. The method according to claim 1, wherein each of steps (a), (b) and (c) is conducted manually by an operator, monitoring the pump and the well and making appropriate changes as required to the pump frequency and wellhead pressure as required, or each of steps (a), (b) and (c) is conducted automatically, wherein an automatic control system conducts the necessary adjustments in each of steps (a), (b) and (c) as required.

9. The method according to claim 8, wherein the automatic control system conducts each of steps (a), (b) and (c), as required by the method, on a regular basis determined on the basis of the well conditions; or indirectly by automatic control of one or more other well or pump parameters; or on the basis of feedback from sensors measuring one or more well parameters selected from the group consisting of: fluid viscosity, fluid flow rate, pressure at a well location, differential pressure over the pump, pump discharge pressure, pressure at a transport line location, pressure at a pump intake, pressure at a pump discharge, temperature at a well location, temperature at a transport line location, temperature at a pump intake, temperature at a pump discharge, temperature at a pump motor, pump frequency, pump power, pump current, choke opening, valve opening, or estimates of other parameters calculated from said measurements.

10. The method according to claim 1, wherein at least one of steps (a), (b) and (c), as required by the method, is conducted semi-automatically, wherein at least one of steps (a), (b) and (c), as required by the method, is conducted by an automatic control system but the decision making is done by an operator.

11. The method according to claim 10, wherein the automatic system conducts each of steps (a), (b) and (c), as required by the method, in a well on the basis of feedback from sensors measuring one or more well parameters selected from the group consisting of: fluid viscosity, fluid flow rate, pressure at a well location, differential pressure over the pump, pump discharge pressure, pressure at a transport line location, pressure at a pump intake, pressure at a pump discharge, temperature at a well location, temperature at a transport line location, temperature at a pump intake, temperature at a pump discharge, temperature at a pump motor, pump frequency, pump power, pump current, choke opening, valve opening, or estimates of other parameters calculated from said measurements.

12. The method according to claim 1, wherein the method further comprises the injection of a viscosity affecting fluid into the well, wherein the viscosity affecting fluid is selected from a diluent, an emulsion breaker and water.

13. The method according to claim 1, wherein an emulsion breaker is injected upstream of a downhole pump in an oil well in steps (a) and (b) to assist inversion of the flow.

14. The method according to claim 1, further comprising a step (d) of carefully adjusting one or both of the wellhead pressure and pump frequency to reach the one or more desired production parameters in the well without reversion to oil continuous production if the production parameters have not been reached in steps (a), (b) or (c).

15. A method for inverting oil continuous flow to water continuous flow and reaching one or more desired transport parameters in a pipeline transporting fluid containing oil and water wherein there is a pump having a pump frequency in the transport pipeline, comprising the following steps:

(a) reducing the pump frequency until either inversion from oil continuous flow to water continuous flow is achieved, a minimal frequency is reached, or a minimal flow is reached;

(b) if inversion has not been achieved in step (a), adjusting the pressure at the reception side of the transport line to achieve the inversion; and (c) stabilising the flow at the condition reached in steps (a) or (b).

16. The method according to claim 15, wherein no changes are made to the pump frequency in step (c) and the pipeline is allowed to flow at the conditions reached in (a) or (b).

17. The method according to claim 15, wherein the pump frequency is reduced further in step (c) until a predefined limit is reached and then production is continued at that lower pump frequency; or the pump frequency is adjusted in step (c) to maintain a selected pump parameter at a constant level reached in steps (a) or (b).

18. The method according to claim 17, wherein said pump parameter is selected from pipeline flow rate, differential pressure over the pump, pump discharge pressure and pump intake pressure.

19. The method according to claim 15, wherein the desired transport parameters in the pipeline are one or more parameters selected from the group consisting of: the desired flow rate, the desired temperature at a location in the pipeline, the desired temperature at the pump intake, the desired temperature at the pump discharge, the desired temperature at the pump motor, the desired pressure at a location in the pipeline, the desired pressure at the pump intake, the desired pressure at the pump discharge, the desired pump power, the desired pump current and the desired pump frequency.

20. The method according to claim 15, wherein the pump is in an oil transport line.

21. The method according to claim 15, wherein the pressure at the reception side of the pump in a transport pipeline wellhead is adjusted in step (b) by adjustment of a choke, a valve or a second pump.

22. The method according to claim 15, wherein each of steps (a), (b) and (c), as required by the method, is conducted manually by an operator, monitoring the pump and the transport pipeline and making appropriate changes as required to the pump frequency and the pressure at the reception side of the transport pipeline as required; or is conducted automatically, wherein an automatic control system conducts the necessary adjustments in each of steps (a), (b) and (c) as required.

23. The method according to claim 22, wherein the automatic control system conducts each of steps (a), (b) and (c), as required by the method, on a regular basis determined on the basis of transport line conditions; or indirectly by automatic control of one or more other pump parameters; or on the basis of feedback from sensors measuring one or more transport pipeline parameters selected from the group consisting of: fluid viscosity, fluid flow rate, pressure at a well location, differential pressure over the pump, pump discharge pressure, pressure at a transport line location, pressure at a pump intake, pressure at a pump discharge, temperature at a well location, temperature at a transport line location, temperature at a pump intake, temperature at a pump discharge, temperature at a pump motor, pump frequency, pump power, pump current, choke opening, valve opening, or estimates of other parameters calculated from said measurements.

24. The method according to claim 15, wherein at least one of steps (a), (b) and (c), as required by the method, is conducted semi-automatically, wherein at least one of steps (a), (b) and (c), as required by the method, is conducted by an automatic control system but the decision making is done by an operator.

25. The method according to claim 24, wherein the automatic system conducts each of steps (a), (b) and (c), as required by the method, in a transport pipeline on the basis of feedback from sensors measuring one or more transport pipeline parameters selected from the group consisting of: fluid viscosity, fluid flow rate, pressure at a well location, differential pressure over the pump, pump discharge pressure, pressure at a transport line location, pressure at a pump intake, pressure at a pump discharge, temperature at a well location, temperature at a transport line location, temperature at a pump intake, temperature at a pump discharge, temperature at a pump motor, pump frequency, pump power, pump current, choke opening, valve opening, or estimates of other parameters calculated from said measurements.

26. The method according to claim 15, wherein the method further comprises the injection of a viscosity affecting fluid into the transport pipeline upstream of the pump, wherein the viscosity affecting fluid is selected from a diluent, an emulsion breaker and water.

27. The method according to claim 15, wherein an emulsion breaker is injected upstream of a pump in a transport line in steps (a) and (b) to assist inversion of the flow.

28. The method according to claim 15, further comprising a step (d) of carefully adjusting one or both the pump frequency and the pressure at the reception side of the transport pipeline to reach the one or more desired transport parameters in the transport pipeline without reversion to oil continuous transport if the transport parameters have not been reached in steps (a) or (b) or optional step (c).

* * * * *